US012656031B2

(12) United States Patent
Shanmugam et al.

(10) Patent No.: US 12,656,031 B2
(45) Date of Patent: Jun. 16, 2026

(54) $CO_2$ REFRIGERATION SYSTEM WITH MULTIPLE RECEIVERS

(71) Applicant: Hill Phoenix, Inc., Conyers, GA (US)

(72) Inventors: Senthilkumar Kandappa Goundar Shanmugam, Covington, GA (US); John Vincent Mullis, Newnan, GA (US); Alireza Behfar, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 22 days.

(21) Appl. No.: 17/957,281

(22) Filed: Sep. 30, 2022

(65) Prior Publication Data

US 2024/0110736 A1 Apr. 4, 2024

(51) Int. Cl.
*F25B 41/20* (2021.01)

(52) U.S. Cl.
CPC ..... *F25B 41/20* (2021.01)

(58) Field of Classification Search
CPC .... F25B 1/10; F25B 41/20; F25B 5/00; F25B 5/04; F25B 7/00; F25B 29/003; F25B 2341/00; F25B 2400/16; F25B 2400/22; F25B 2400/161; F25B 2600/05; F25B 2600/2501; F25B 2700/1933; F25B 2700/19; F25B 2400/23; F25B 2400/075; F25B 2309/061; F25B 25/005; F25B 2400/06; Y02A 30/27
See application file for complete search history.

(56) References Cited

U.S. PATENT DOCUMENTS 2,799,142 A * 7/1957 Schubert ..... F25B 9/006 62/502
4,084,405 A 4/1978 Schibbye et al.
9,726,411 B2 8/2017 Zimmermann
11,029,068 B2 6/2021 Christensen et al.
2010/0132399 A1 6/2010 Mitra et al.
(Continued)

FOREIGN PATENT DOCUMENTS

CA 3068882 A1 * 11/2020 ..... F25B 1/10
CN 113654262 11/2021
(Continued)

OTHER PUBLICATIONS

WO-2022249566-A1 English Translation (Year: 2022).*
(Continued)

*Primary Examiner* — Frantz F Jules
*Assistant Examiner* — Devon Moore
(74) *Attorney, Agent, or Firm* — Fish & Richardson P.C.

(57) ABSTRACT

A refrigeration system having a primary receiver, a secondary receiver, a first gas bypass valve, and second gas bypass valve, a feed control valve, and a controller. The primary receiver has a primary receiver operating pressure and is configured to collect a refrigerant circulated by the refrigeration system. The secondary receiver includes a liquid refrigerant inlet fluidly coupled to a primary receiver liquid refrigerant outlet. The feed control valve is coupled between the primary receiver liquid outlet and the secondary receiver liquid refrigerant inlet. The controller operates the feed control valve to control a flow of a liquid refrigerant from the primary receiver to the secondary receiver.

31 Claims, 6 Drawing Sheets

(56) References Cited

U.S. PATENT DOCUMENTS

| | | | | |
|---|---|---|---|---|
| 2013/0298593 | A1 | 11/2013 | Christensen | |
| 2013/0319036 | A1 | 12/2013 | Taras et al. | |
| 2014/0151015 | A1 | 6/2014 | Sun et al. | |
| 2017/0328604 | A1 | 11/2017 | Fredslund et al. | |
| 2019/0072299 | A1 | 3/2019 | Najafifard et al. | |
| 2020/0124330 | A1 * | 4/2020 | Hayes | F25B 40/06 |
| 2024/0151437 | A1 | 5/2024 | Shanmugam et al. | |

FOREIGN PATENT DOCUMENTS

| | | | | |
|---|---|---|---|---|
| EP | 0631095 | A2 * | 6/1994 | F25B 49/02 |
| GB | 2446062 | | 7/2008 | |
| JP | 2011247504 | | 12/2011 | |
| WO | WO 2013016403 | | 1/2013 | |
| WO | WO-2018079238 | A1 * | 5/2018 | F25B 1/00 |
| WO | WO-2022249566 | A1 * | 12/2022 | F25B 1/00 |

OTHER PUBLICATIONS

Kysor Warren CO2 Transcritical eCO2 Boost Installation and Operation Manual (Year: 2018).*

WO-2018079238-A1 English Translation (Year: 2018).*

International Search Report and Written Opinion in International Appln. No. PCT/US2023/075541, mailed on Feb. 6, 2024, 15 pages.

International Search Report and Written Opinion in International Appln. No. PCT/US2023/078590, mailed on Mar. 6, 2024, 15 pages.

International Preliminary Report on Patentability in International Appln. No. PCT/US2023/075541, mailed on Apr. 10, 2025, 10 pages.

* cited by examiner

$CO_2$ REFRIGERATION SYSTEM WITH MULTIPLE RECEIVERS

TECHNICAL FIELD

This disclosure relates to cooling systems, particularly cooling systems that use carbon dioxide ($CO_2$) as a refrigerant.

BACKGROUND

Refrigeration systems are often used to provide cooling to temperature-controlled display devices (e.g., cases, merchandisers, etc.) in supermarkets, cold Storage, refrigerated warehouses, process facilities and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically (1) compressed to a high temperature high pressure state (e.g., by a compressor of the refrigeration system), (2) cooled/condensed to a lower temperature state (e.g., in a gas cooler or condenser that absorbs heat from the refrigerant), (3) expanded to a lower pressure (e.g., through an expansion valve), and (4) evaporated to provide cooling by absorbing heat into the refrigerant.

SUMMARY

The present disclosure relates to systems and methods for cooling.

Implementations of the present disclosure include a refrigeration system having a primary receiver, a secondary receiver, a first gas bypass valve, and second gas bypass valve, a feed control valve, and a controller. The primary receiver has a primary receiver operating pressure and is configured to collect a refrigerant circulated by the refrigeration system. The primary receiver includes a primary receiver inlet through which refrigerant enters the primary receiver, a primary receiver gas outlet through which gas refrigerant exits the primary receiver, and a primary receiver liquid refrigerant outlet through which liquid refrigerant exits the primary receiver. The secondary receiver has a secondary receiver operating pressure that is less than the primary receiver operating pressure. The secondary receiver includes a liquid refrigerant inlet fluidly coupled to the primary receiver liquid refrigerant outlet and configured to receive liquid refrigerant from the primary receiver, and a secondary receiver gas outlet through which gas refrigerant exits the secondary receiver. The first gas bypass valve is fluidly coupled to the primary receiver gas outlet and is operable to control a flow of the gas refrigerant from the primary receiver through the first gas bypass valve. The second gas bypass valve is fluidly coupled to the secondary receiver gas outlet and is operable to control a flow of the gas refrigerant from the secondary receiver through the second gas bypass valve. The feed control valve is coupled between the primary receiver liquid outlet and the secondary receiver liquid refrigerant inlet. The controller is configured to operate the feed control valve to control a flow of a liquid refrigerant from the primary receiver to the secondary receiver.

In some implementations, the receiver operating pressure in the primary receiver is between about 60 bar and about 90 bar, and the receiver operating pressure in the secondary receiver is less than about 60 bar.

In some implementations, the controller is configured to operate the feed control valve to maintain a level of liquid refrigerant in the secondary receiver at a setpoint.

In some implementations, the controller is configured to operate the feed control valve to maintain a level of liquid refrigerant in the secondary receiver within a predetermined range.

In some implementations, the controller is configured to maintain a level of liquid refrigerant in the primary receiver at or above a minimum level.

In some implementations, the controller is configured to maintain a level of liquid refrigerant in the primary receiver at or above a minimum level and a level of liquid refrigerant in the secondary receiver at or above a minimum level.

In some implementations, the feed control valve includes a pressure regulator valve.

In some implementations, the feed control valve includes a solenoid valve.

In some implementations, the refrigeration system further includes a first set of one or more compressors fluidly coupled to the primary receiver gas outlet; and a second set of one or more compressors fluidly coupled to the secondary receiver gas outlet.

In some implementations, the refrigeration system includes a first subsystem and a second subsystem, wherein the first subsystem receives liquid refrigerant from the primary receiver, wherein the second subsystem receives liquid refrigerant from the secondary receiver.

In some implementations, the refrigeration system further includes a medium temperature (MT) subsystem configured to receive liquid refrigerant from the secondary receiver. The MT subsystem includes one or more MT compressors configured to operate in a transcritical state, one or more MT evaporators, and one or more MT expansion valves.

In some implementations, the refrigeration system further includes a low temperature (LT) subsystem configured to receive liquid refrigerant from the primary receiver.

The LT subsystem includes one or more LT compressors configured to operate in a subcritical state, one or more LT evaporators, and one or more LT expansion valves In some implementations, the refrigeration system further includes: an LT subsystem and an MT subsystem each configured to receive liquid refrigerant from the secondary receiver; and a primary subsystem configured to receive liquid refrigerant from the primary receiver.

In some implementations, the primary subsystem includes an air-conditioning system.

In some implementations, the primary subsystem includes a process cooling loop.

In some implementations, an ejector fluidly coupled between a gas cooler of the refrigeration system and the first receiver.

In some implementations, a parallel compressor coupled between an outlet of the first receiver and an outlet of one or more MT subsystem compressors.

In some implementations, an additional receiver configured to receive liquid refrigerant from the secondary receiver.

In some implementations, the refrigerant is carbon dioxide.

Further implementations of the present disclosure include a refrigeration system having two or more receivers, a liquid refrigerant feed line, one or more feed control valves, and a controller. The two or more receivers are configured to collect refrigerant circulated by the refrigeration system. The liquid refrigerant feed line is between a liquid refrigerant outlet of a first one of the receivers and a liquid refrigerant inlet of a second one of the receivers having a receiver operating pressure lower than the receiver operating pressure of the first one of the receivers. The one or more feed control valves are in the liquid refrigerant feed line. The controller is configured to operate the one or more feed control valves to control a level of liquid refrigerant in at least the second one of the receivers.

In some implementations, the two or more receivers include a primary receiver, a secondary receiver, and a tertiary receiver. The secondary receiver receives a flow of liquid refrigerant from the primary receiver and has a secondary receiver operating pressure that is lower than the primary receiver operating pressure. The tertiary receiver receives a flow of liquid refrigerant from the secondary receiver and has a tertiary receiver operating pressure that is lower than the secondary receiver operating pressure.

Further implementations of the present disclosure include a method for operating a refrigeration system including: collecting a refrigerant circulated by the refrigeration system within a primary receiver having a primary receiver operating pressure, the primary receiver comprising a liquid refrigerant outlet through which the refrigerant exits the receiver; providing liquid refrigerant from the primary receiver to a secondary receiver having a secondary receiver operating pressure that is lower than the primary operating pressure; operating a first gas bypass valve fluidly coupled to the primary receiver gas outlet of the to control to control a flow of the gas refrigerant from the primary receiver through the first gas bypass valve; operating a second gas bypass valve fluidly coupled to the secondary receiver gas outlet to control a flow of the gas refrigerant from the secondary receiver through the second gas bypass valve; and operating a feed control valve to control a flow of a liquid refrigerant from the primary receiver to the secondary receiver.

In some implementations, operating the feed control valve to control a flow of liquid refrigerant from the receiver to the secondary receiver includes maintaining a liquid level in the secondary receiver within a particular operating range.

In some implementations, the method further includes monitoring a liquid refrigerant level in the primary receiver, and maintaining the liquid refrigerant level in the primary receiver at or above a predetermined minimum level.

Further implementations of the present disclosure include a method for operating a refrigeration system including collecting a gas refrigerant circulated by the refrigeration system within a primary receiver having a primary operating pressure, the receiver comprising a liquid refrigerant outlet through which liquid refrigerant exits the receiver; providing liquid refrigerant from the primary receiver to a secondary receiver having a secondary receiver operating pressure that is less than the primary receiver operating pressure; and operating a feed control valve to control a flow of a liquid refrigerant from the primary receiver to the secondary receiver to maintain a level of liquid refrigerant in the secondary receiver within a particular operating range.

In some implementations, the method further includes monitoring a liquid refrigerant level in the primary receiver, and maintaining the liquid refrigerant level in the primary receiver at or above a predetermined minimum level.

In some implementations, the method further includes receiving liquid refrigerant from the secondary receiver into a tertiary receiver; and operating a feed control valve to control a flow of a liquid refrigerant from the secondary receiver to the tertiary receiver to maintain a level of liquid refrigerant in the tertiary receiver within a particular operating range.

Particular implementations of the subject matter described in this specification can be implemented so as to realize one or more of the following advantages.

Implementations of the present disclosure may allow a system to operate more efficiently with varying environmental conditions.

Implementations of the present disclosure may help to balance the charge of a system for winter and summer operating conditions.

Implementations of the present disclosure may allow a portion of a refrigeration system to use lower pressure piping, lower pressure valves, and other lower pressure fluid components.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

In various implementations, a cooling system has two or more receivers. Each of the receivers may be in the form of a flash tank. In some implementations of a two-receiver system, a gas cooler outlet for a refrigeration system is connected to the higher pressure receiver (primary receiver) (for example, 60 bar or 90 bar) via a high pressure valve. A high-pressure valve maintains gas cooler pressure. The primary receiver supplies liquid to high pressure evaporators, which can be, for example, a display case, a walk-in cooler evaporator, or air conditioning evaporator (e.g., MT suction group 1). The operating pressure of the primary receiver can be controlled by another pressure regulating valve or flash gas bypass valve which is connected to a suction group. A liquid level sensor/switch in the primary receiver/flash tank can ensure a minimum liquid level in the tank.

A secondary receiver is connected to primary receiver through a feed control valve. The primary receiver supplies liquid to secondary receiver. The secondary receiver's operating pressure can be maintained/controlled by another pressure regulating valve which is connected to another suction group (e.g., MT suction group 2 an LT suction group).

A liquid level sensor is installed in a secondary receiver/flash tank. The liquid level sensor measures the liquid level in the secondary receiver. The liquid level sensor is coupled to a controller that uses the liquid level sensor to control the liquid level in the secondary receiver. For example, the controller can send a signal to the liquid feed to open when the level in the secondary receiver goes low and send a signal to the liquid feed valve to close when the liquid level in the secondary receiver goes high. The liquid level sensor can also ensure a minimum liquid level in the secondary receiver. The secondary receiver may operate at intermediate pressure (for example, 45 bar or 60 bar).

Further examples of multiple receiver systems are described below. Referring generally to the Figures, a $CO_2$ refrigeration system is shown, according to various exemplary implementations. The $CO_2$ refrigeration system may be a vapor compression refrigeration system which uses primarily carbon dioxide (i.e., $CO_2$) as a refrigerant. In some implementations, a $CO_2$ booster system is used to provide cooling for temperature controlled display devices in a supermarket or other similar facility.

Figure 1:
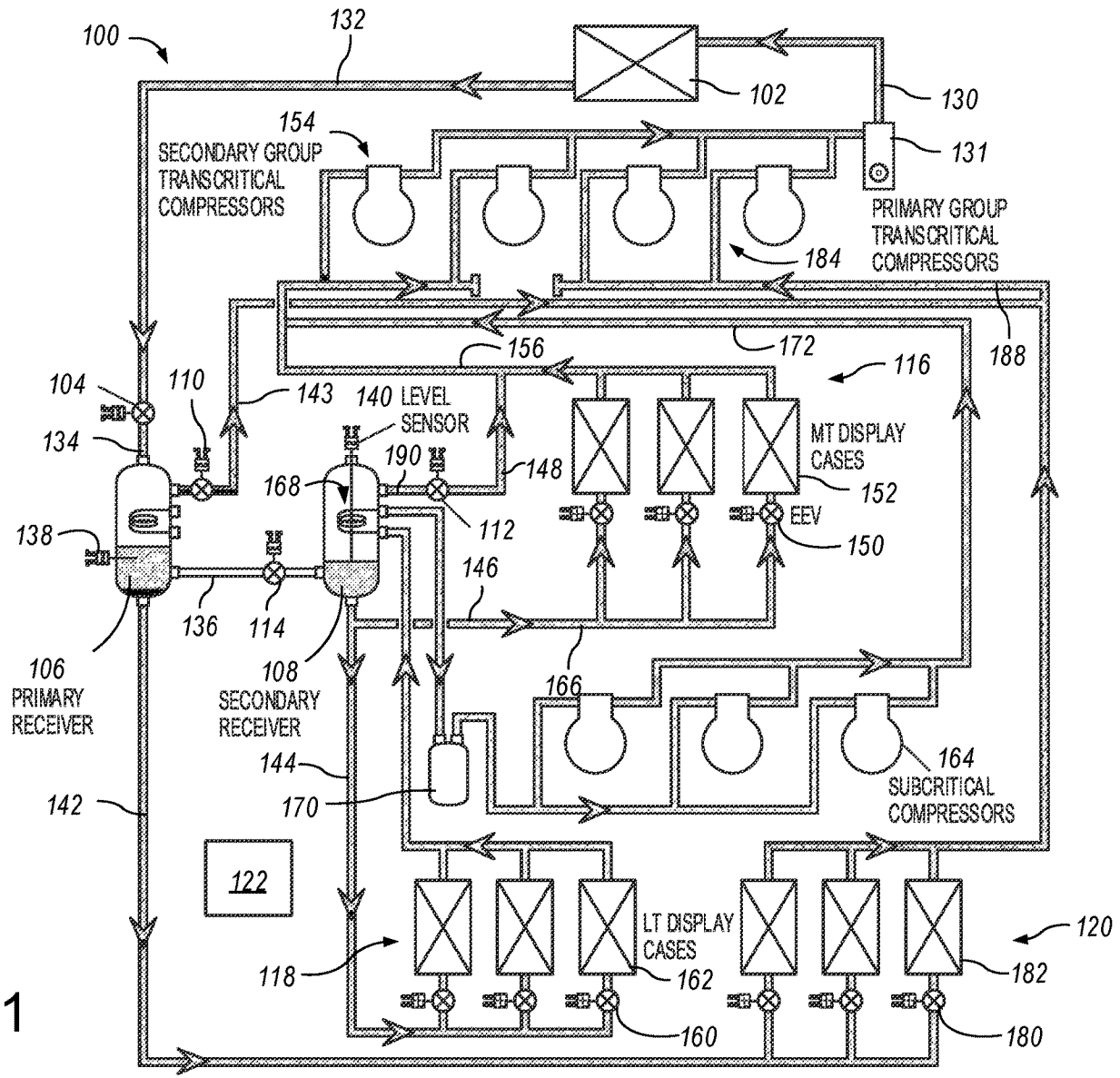
FIG. 1 is a block diagram of a $CO_2$ transcritical booster system having dual receivers according to an exemplary implementation.

FIG. 1 is a block diagram of a $CO_2$ refrigeration system according to an exemplary implementation. $CO_2$ refrigeration system 100 may be a vapor compression refrigeration system which uses primarily carbon dioxide ($CO_2$) as a refrigerant. However, it is contemplated that other refrigerants can be substituted for $CO_2$ without departing from the teachings of the present disclosure.

$CO_2$ refrigeration system 100 and is shown to include a system of pipes, conduits, or other fluid channels for transporting the $CO_2$ refrigerant between various components of $CO_2$ refrigeration system 100. The thermodynamic components of $CO_2$ refrigeration system 100 include a gas cooler/condenser 102, a high pressure valve 104, a primary receiver 106, and secondary receiver 108, a primary gas bypass valve 110, secondary gas bypass valve 112, feed control valve 114, a medium-temperature ("MT") subsystem 116, a low-temperature ("LT") subsystem 118, a primary subsystem 120, and controller 122. (In this example, the primary subsystem can also be referred to as an MT subsystem.)

Gas cooler/condenser 102 may be a heat exchanger or other similar device for removing heat from the $CO_2$ refrigerant. Gas cooler/condenser 102 is shown receiving $CO_2$ gas from fluid conduit 130. Refrigerant passes through oil separator 131 before flowing to gas cooler/condenser 102. In some implementations, the $CO_2$ gas in fluid conduit 130 may have a pressure within a range from approximately 45 bar to approximately 100 bar (i.e., about 650 psig to about 1450 psig), depending on ambient temperature and other operating conditions. In some implementations, gas cooler/condenser 102 may partially or fully condense $CO_2$ gas into liquid $CO_2$ (e.g., if system operation is in a subcritical region). The condensation process may result in fully saturated $CO_2$ liquid or a two-phase liquid-vapor mixture (e.g., having a thermodynamic vapor quality between 0 and 1). In other implementations, gas cooler/condenser 102 may cool the $CO_2$ gas (e.g., by removing superheat) without condensing the $CO_2$ gas into $CO_2$ liquid (e.g., if system operation is in a supercritical region). In some implementations, the cooling/condensation process is an isobaric process. Gas cooler/condenser 102 is shown outputting the cooled and/or condensed $CO_2$ refrigerant into fluid conduit 132.

In some implementations, $CO_2$ refrigeration system 100 includes a temperature sensor and a pressure sensor configured to measure the temperature and pressure of the $CO_2$ refrigerant exiting gas cooler/condenser 102. Sensors can be installed along fluid conduit 132, within gas cooler/condenser 102, or otherwise positioned to measure the temperature and pressure of the $CO_2$ refrigerant exiting gas cooler/condenser 102. In some implementations, $CO_2$ refrigeration system 100 includes a condenser fan that provides airflow across gas cooler/condenser 102. The speed of the condenser fan can be controlled to increase or decrease the airflow across gas cooler/condenser 102 to modulate the amount of cooling applied to the CO 2 refrigerant within gas cooler/condenser 102. In some implementations, $CO_2$ refrigeration system 100 also includes a temperature sensor and/or a pressure sensor configured to measure the temperature and/or pressure of the ambient air that flows across gas cooler/condenser 102 to provide cooling for the $CO_2$ refrigerant contained therein.

High pressure valve 104 receives the cooled and/or condensed $CO_2$ refrigerant from fluid conduit 132 and outputs the $CO_2$ refrigerant to fluid conduit 134. High pressure valve 104 may control the pressure of the $CO_2$ refrigerant in gas cooler/condenser 102 by controlling an amount of $CO_2$ refrigerant permitted to pass through high pressure valve 104. In some implementations, high pressure valve 104 is a high pressure thermal expansion valve (e.g., if the pressure in fluid conduit 132 is greater than the pressure in fluid conduit 134). In such implementations, high pressure valve 104 may allow the $CO_2$ refrigerant to expand to a lower pressure state. The expansion process may be an isenthalpic and/or adiabatic expansion process, resulting in a two-phase flash of the high pressure $CO_2$ refrigerant to a lower pressure, lower temperature state. The expansion process may produce a liquid/vapor mixture (e.g., having a thermodynamic vapor quality between 0 and 1). In some implementations, the $CO_2$ refrigerant expands to a pressure of approximately 38 bar (e.g., about 550 psig), which corresponds to a temperature of approximately 40° F. The $CO_2$ refrigerant then flows from fluid conduit 134 into primary receiver 106.

Primary receiver 106 collects the CO 2 refrigerant from fluid conduit 134. In some implementations, primary receiver 106 may be a flash tank or other fluid reservoir. Primary receiver 106 includes a $CO_2$ liquid portion and a $CO_2$ vapor portion and may contain a partially saturated mixture of $CO_2$ liquid and $CO_2$ vapor. In some implementations, primary receiver 106 separates the $CO_2$ liquid from the $CO_2$ vapor.

Secondary receiver 108 is fluidly coupled to primary receiver 106 by way of feed conduit 136. A portion of liquid refrigerant exiting primary receiver 106 can be received in secondary receiver 108. Feed control valve 114 controls a flow of a liquid refrigerant from primary receiver 106 to secondary receiver 108. Examples of a feed control valve 114 include a pressure regulating valve, a solenoid valve, a flow meter, or a motorized 'liquid feed' valve. Feed control valve 114 can be operated (e.g., by way of controller 122) to control a liquid level in secondary receiver 108 and/or primary receiver 106.

The receiver operating pressure of secondary receiver 108 is lower than receiver operating pressure of primary receiver 106. In one implementation, the receiver operating pressure of primary receiver 106 is about 90 bar, and the receiver operating pressure of secondary receiver 108 is about 60 bar. In another implementation, the receiver pressure of primary receiver 106 is about 60 bar, and the receiver operating pressure of secondary receiver 108 is about 45 bar.

Each of primary receiver 106 and secondary receiver 108 include liquid level-measuring devices. The liquid level-measuring devices can be, for example, a level switch or a level sensor. The liquid level measuring device can be coupled to controller 122. In one example, primary receiver 106 includes a level switch 138 and secondary receiver 108 includes a level sensor 140. Level sensor 140 may provide a signal corresponding to the level of liquid refrigerant in secondary receiver 108.

Information from level sensor 140 can be used by controller 122 to control a liquid level in secondary receiver 108. The liquid level in the secondary receiver 108 can be maintained within a pre-determined range. As examples, controller 122 can maintain a liquid level in secondary receiver 108 between 40 and 60% full, between 50 and 60% full, or at least 50% full.

In certain implementations, feed control valve 114 is operated to control pressure in one or more receivers. For example, if the pressure drops to below a desired level in secondary receiver 108, feed control valve 114 can be opened to raise the liquid level in secondary receiver 108 to correct for the pressure drop.

$CO_2$ liquid may exit primary receiver 106 through feed conduit 136 and conduit 142. Conduit 142 may be a liquid header leading to primary subsystem 120. The $CO_2$ vapor may exit primary receiver 108 through flash gas line 143. Conduit 143 is shown leading the $CO_2$ vapor to a primary gas bypass valve 110 (described in greater detail below).

$CO_2$ liquid may exit secondary receiver 108 and pass into conduit 144 and conduit 146. Conduit 146 may be a liquid header leading to MT subsystem 116. Conduit 144 may be a liquid header leading to LT subsystem 118. The $CO_2$ vapor may exit secondary receiver 108 through flash gas line 148. Flash gas line 148 is shown leading the $CO_2$ vapor to a secondary gas bypass valve 112 (described in greater detail below).

In some implementations, $CO_2$ refrigeration system 100 includes temperature sensors and/or pressure sensors configured to measure the temperature and pressure within primary receiver 106, secondary receiver 108, or both. Sensors can be installed in or on primary receiver 106, in or on secondary receiver 108, or along any of the fluid conduits that contain $CO_2$ refrigerant at the same temperature and/or pressure as primary receiver 106 or secondary receiver 108, as the case may be.

MT subsystem 116 is shown to include one or more expansion valves 150, one or more MT evaporators 152, and one or more secondary group transcritical compressors 154. In various implementations, any number of expansion valves 150, MT evaporators 152, and secondary group transcritical compressors 154 may be present. Expansion valves 150 may be electronic expansion valves or other similar expansion valves. Expansion valves 150 are shown receiving liquid CO 2 refrigerant from fluid conduit 146 and outputting the $CO_2$ refrigerant to MT evaporators 152. Expansion valves 150 may cause the $CO_2$ refrigerant to undergo a rapid drop in pressure, thereby expanding the $CO_2$ refrigerant to a lower pressure, lower temperature two-phase state. In some implementations, expansion valves 150 may expand the $CO_2$ refrigerant to a pressure of approximately 20 bar to 25 bar. The expansion process may be an isenthalpic and/or adiabatic expansion process.

MT evaporators 152 are shown receiving the cooled and expanded $CO_2$ refrigerant from expansion valves 150. In some implementations, MT evaporators 152 may be associated with display cases/devices (e.g., if $CO_2$ refrigeration system 100 is implemented in a supermarket setting). MT evaporators 152 may be configured to facilitate the transfer of heat from the display cases/devices into the $CO_2$ refrigerant. The added heat may cause the $CO_2$ refrigerant to evaporate partially or completely. According to one implementation, the CO 2 refrigerant is fully evaporated in MT evaporators 152. In some implementations, the evaporation process may be an isobaric process. MT evaporators 152 are shown outputting the $CO_2$ refrigerant via suction line 156, leading to secondary group transcritical compressors 154.

Secondary group transcritical compressors 154 compress the $CO_2$ refrigerant into a superheated gas having a pressure within a range of approximately 45 bar to approximately 100 bar. The output pressure from secondary group transcritical compressors 154 may vary depending on ambient temperature and other operating conditions. In the example shown in FIG. 1, secondary group transcritical compressors 154 operate in a transcritical mode. In operation, the $CO_2$ discharge gas exits secondary group transcritical compressors 154 and flows through conduit 130 into gas cooler/condenser 102.

LT subsystem 118 is shown to include one or more expansion valves 160, one or more LT evaporators 162, and one or more subcritical compressors 164. In various implementations, any number of expansion valves 160, LT evaporators 162, and subcritical compressors 164 may be present. In some implementations, LT subsystem 118 may be omitted and the $CO_2$ refrigeration system 100 may operate with an AC module interfacing with only MT subsystem 116.

Expansion valves 160 may be electronic expansion valves or other similar expansion valves. Expansion valves 160 are shown receiving liquid CO 2 refrigerant from fluid conduit 146 and outputting the $CO_2$ refrigerant to LT evaporators 162. Expansion valves 160 may cause the $CO_2$ refrigerant to undergo a rapid drop in pressure, thereby expanding the $CO_2$ refrigerant to a lower pressure, lower temperature two-phase state. The expansion process may be an isenthalpic and/or adiabatic expansion process. In certain implementations, expansion valves 160 may expand the $CO_2$ refrigerant to a lower pressure than expansion valves 160, thereby resulting in a lower temperature $CO_2$ refrigerant. Accordingly, LT subsystem 118 may be used in conjunction with a freezer system or other lower temperature display cases.

LT evaporators 162 are shown receiving the cooled and expanded $CO_2$ refrigerant from expansion valves 160. In some implementations, LT evaporators may be associated with display cases/devices (e.g., if $CO_2$ refrigeration system 100 is implemented in a supermarket setting). LT evaporators 162 may be configured to facilitate the transfer of heat from the display cases/devices into the $CO_2$ refrigerant. The added heat may cause the $CO_2$ refrigerant to evaporate partially or completely. In some implementations, the evaporation process may be an isobaric process.

LT evaporators 162 are shown outputting the $CO_2$ refrigerant via suction line 166, leading to subcritical compressors 164. In this example, before reaching subcritical compressors 164, the refrigerant passes through heat exchanger 168 in secondary receiver 108 and to accumulator 170.

Subcritical compressors 164 compress the $CO_2$ refrigerant. In some implementations, subcritical compressors 164 may compress the $CO_2$ refrigerant to a pressure of approximately 30 bar, having a saturation temperature of approximately 23° F. In this example, subcritical compressors 164 operate in a subcritical mode. Subcritical compressors 164 are shown outputting the $CO_2$ refrigerant through discharge line 172. Discharge line 172 may be fluidly connected with the suction (e.g., upstream) side of secondary group transcritical compressors 154.

Primary subsystem 120 is shown to include one or more expansion valves 180, one or more evaporators 182, and one or more primary group transcritical compressors 184. In various implementations, any number of expansion valves 180, evaporators 182, and primary group transcritical compressors 184 may be present.

In the context of this example, "primary subsystem" refers to the loop receiving its refrigerant from a primary receiver (in this case, primary receiver 106). In some implementations, the primary subsystem operates a high pressure cooling loop. As one example, the primary receiver 106 may have a pressure between approximately 60 bar and approximately 90 bar. In one implementation, primary system 120 includes display case evaporators for display cases. In another implementation, primary system 120 includes evaporators for air conditioning. In still another implementation, primary system 120 includes evaporators for process cooling. In certain implementations, primary system 120 provides cooling for two or more types of evaporators (e.g., air conditioning and display cases).

Expansion valves 180 may be electronic expansion valves or other similar expansion valves. Expansion valves 180 are shown receiving liquid CO 2 refrigerant from fluid conduit 142 and outputting the $CO_2$ refrigerant to MT evaporators 182. Expansion valves 180 may cause the $CO_2$ refrigerant to undergo a rapid drop in pressure, thereby expanding the $CO_2$ refrigerant to a lower pressure, lower temperature two-phase state. In some implementations, expansion valves 180 may expand the $CO_2$ refrigerant to a pressure of approximately 20 bar to 25 bar (or higher). The expansion process may be an isenthalpic and/or adiabatic expansion process.

Evaporators 182 are shown receiving the cooled and expanded $CO_2$ refrigerant from expansion valves 180. In some implementations, MT evaporators may be associated with display cases/devices (e.g., if $CO_2$ refrigeration system 100 is implemented in a supermarket setting). Evaporators 182 may be configured to facilitate the transfer of heat from the display cases/devices into the $CO_2$ refrigerant. The added heat may cause the $CO_2$ refrigerant to evaporate partially or completely. According to one implementation, the CO 2 refrigerant is fully evaporated in evaporators 182. In some implementations, the evaporation process may be an isobaric process. Evaporators 182 are shown outputting the $CO_2$ refrigerant via suction line 188, leading to primary group transcritical compressors 184.

Primary group transcritical compressors 184 compress the $CO_2$ refrigerant into a superheated gas having a pressure within a range of approximately 45 bar to approximately 100 bar. The output pressure from primary group transcritical compressors 184 may vary depending on ambient temperature and other operating conditions. In the example shown in FIG. 1, primary group transcritical compressors 184 operate in a transcritical mode. In operation, the $CO_2$ discharge gas exits primary group transcritical compressors 184 and flows through conduit 130 into gas cooler/condenser 102.

$CO_2$ refrigeration system 100 is shown to include a primary gas bypass valve 110. Primary gas bypass valve 110 may receive the $CO_2$ vapor from fluid conduit 143 and output the $CO_2$ refrigerant to primary subsystem 120. In some implementations, primary gas bypass valve 110 is arranged in series with primary group transcritical compressors 184. In other words, $CO_2$ vapor from primary receiver 106 may pass through both primary gas bypass valve 110 and primary group transcritical compressors 184. Primary group transcritical compressors 184 may compress the $CO_2$ vapor passing through primary gas bypass valve 110 from a low pressure state (e.g., approximately 30 bar or lower or higher) to a high pressure state (e.g., 45-100 bar).

Primary gas bypass valve 110 can be operated to control a flow of gas refrigerant from fluid conduit 143 into suction line 188. Primary gas bypass valve 110 may be operated to regulate or control the pressure within primary receiver 106 (e.g., by adjusting an amount of $CO_2$ refrigerant permitted to pass through primary gas bypass valve 110). For example, primary gas bypass valve 110 may be adjusted (e.g., variably opened or closed) to adjust the mass flow rate, volume flow rate, or other flow rates of the $CO_2$ refrigerant through primary gas bypass valve 110. Primary gas bypass valve 110 may be opened and closed (e.g., manually, automatically, by a controller, etc.) as needed to regulate the pressure within primary receiver 106.

In some implementations, primary gas bypass valve 110 includes a sensor for measuring a flow rate (e.g., mass flow, volume flow, etc.) of the $CO_2$ refrigerant through primary gas bypass valve 110. In other implementations, primary gas bypass valve 110 includes an indicator (e.g., a gauge, a dial, etc.) from which the position of primary gas bypass valve 110 may be determined. This position may be used to determine the flow rate of $CO_2$ refrigerant through primary gas bypass valve 110, as such quantities may be proportional or otherwise related.

In some implementations, primary gas bypass valve 110 may be a thermal expansion valve. According to one implementation, the pressure within primary receiver 106 is regulated by primary gas bypass valve 110 to a pressure of approximately 60 bar.

$CO_2$ refrigeration system 100 is shown to include a secondary gas bypass valve 112. Secondary gas bypass valve 112 may receive the $CO_2$ vapor from fluid conduit 190 and output the $CO_2$ refrigerant toward secondary group transcritical compressors 154. In some implementations, secondary gas bypass valve 112 is arranged in series with secondary group transcritical compressors 154. In other words, $CO_2$ vapor from primary receiver 106 may pass through both primary gas bypass valve 110 and secondary group transcritical compressors 154. Secondary group transcritical compressors 154 may compress the $CO_2$ vapor passing through secondary gas bypass valve 112 from a low pressure state (e.g., approximately 30 bar or lower or higher) to a high pressure state (e.g., approximately 45-100 bar).

Secondary gas bypass valve 112 can be operated to control a flow of gas refrigerant from secondary receiver 108 into suction line 156. Secondary gas bypass valve 112 may be operated to regulate or control the pressure within secondary receiver 108 (e.g., by adjusting an amount of $CO_2$ refrigerant permitted to pass through secondary gas bypass valve 112). For example, secondary gas bypass valve 112 may be adjusted (e.g., variably opened or closed) to adjust the mass flow rate, volume flow rate, or other flow rates of the $CO_2$ refrigerant through secondary gas bypass valve 112. Secondary gas bypass valve 112 may be opened and closed (e.g., manually, automatically, by a controller, etc.) as needed to regulate the pressure within secondary receiver 108.

In some implementations, secondary gas bypass valve 112 includes a sensor for measuring a flow rate (e.g., mass flow, volume flow, etc.) of the $CO_2$ refrigerant through primary gas bypass valve 110. In other implementations, secondary gas bypass valve 112 includes an indicator (e.g., a gauge, a dial, etc.) from which the position of secondary gas bypass valve 112 may be determined. This position may be used to determine the flow rate of $CO_2$ refrigerant through secondary gas bypass valve 112, as such quantities may be proportional or otherwise related.

In some implementations, secondary gas bypass valve 112 may be a thermal expansion valve. According to one implementation, the pressure within secondary receiver 108 is regulated by secondary gas bypass valve 112 to a pressure of approximately 38 bar (or lower or higher).

Applications of systems and processes described in the present disclosure include a commercial supermarket, a cold storage warehouse, and a process cooling facility.

In one implementation, a commercial supermarket has two sets of evaporators, for example, 60 bar and 45 bar medium temp evaporators. The 60 bar evaporator uses high pressure piping. The 45 bar medium temp evaporator uses low pressure piping.

In other implementation, a cold storage/refrigerated warehouse or processing cooling facility has two evaporator ratings, for example, a 90 bar evaporator and a 60 bar evaporator, or 90 bar evaporator and a 45 bar evaporator. In some implementations, a cold storage warehouse or process cooling facility includes refrigeration and air conditioning.

Figure 2:
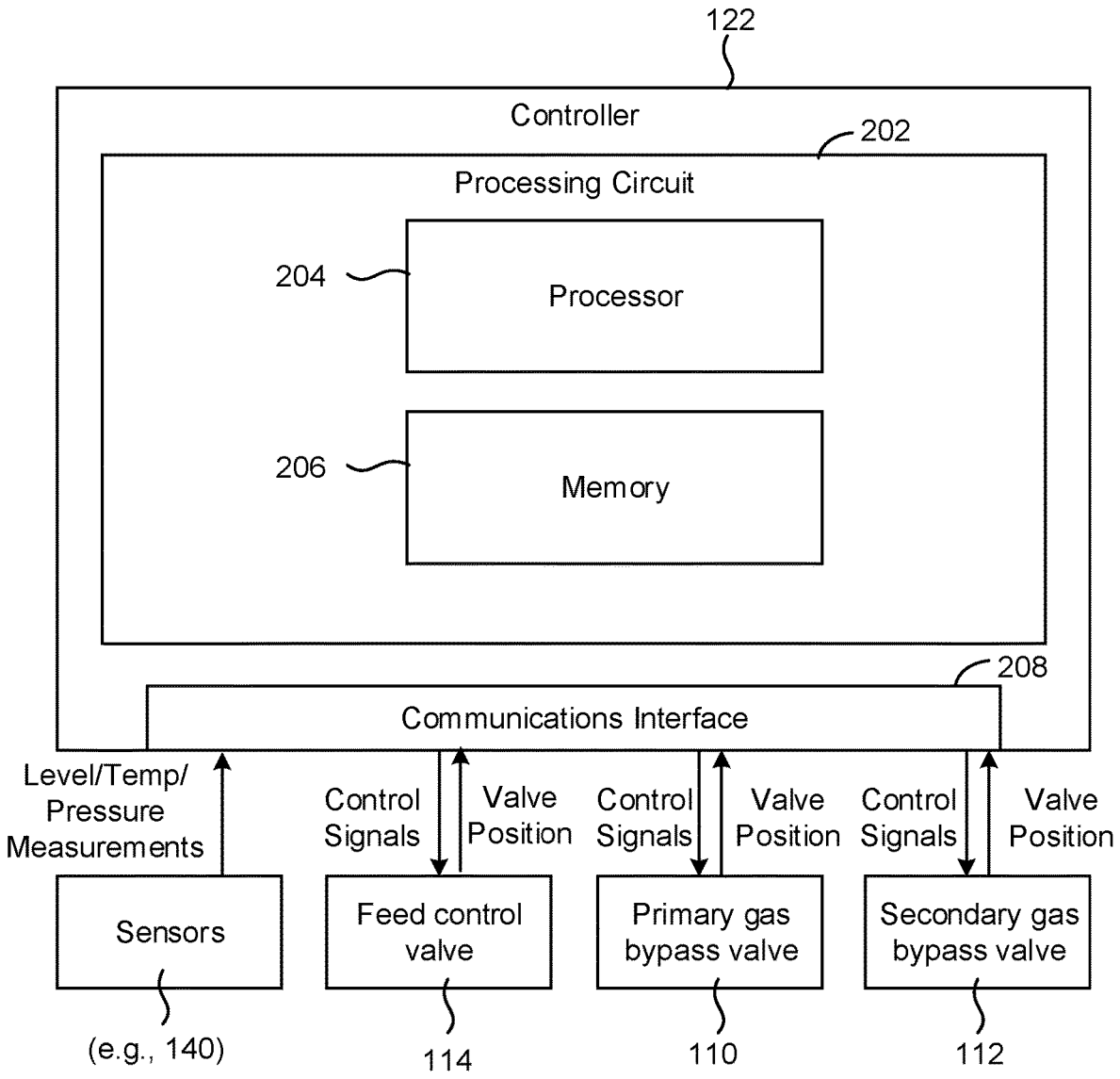
FIG. 2 is a block diagram illustrating a controller according to an exemplary implementation.

FIG. 2 is a block diagram illustrating controller 122 in greater detail according to an exemplary implementation. Controller 122 may receive signals from one or more measurement devices (e.g., pressure sensors, temperature sensors, flow sensors, etc.) located within $CO_2$ refrigeration system 100. For example, controller 122 is shown receiving measurements from level sensor 140. Controller 122 may use the input signals to determine appropriate control actions for controllable devices of $CO_2$ refrigeration system 100 (e.g., compressors, valves, flow diverters, power supplies, etc.). For example, controller 122 is shown providing control signals to primary gas bypass valve 110, secondary gas bypass valve 112, and feed control valve 114.

In some implementations, controller 122 is configured to operate feed control valve 114 at a desired setpoint or within a desired range. Controller 122 also operates primary gas bypass valve 110 and secondary gas bypass valve 112 to control pressure in primary receiver 106 and secondary receiver 108, respectively. In certain implementations, controller 122 uses a valve position of primary gas bypass valve 110 as a proxy for $CO_2$ refrigerant flow rate. In some implementations, controller 122 operates high pressure valve 104 and expansion valves of MT subsystem 116, LT subsystem 118, and primary subsystem 120 to regulate the flow of refrigerant in system 100 and various sub-systems of system 100.

Controller 122 may include feedback control functionality for adaptively operating the various components of $CO_2$ refrigeration system 100. For example, controller 122 may receive a setpoint (e.g., a level setpoint, a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 122 based on a history of data measurements. In some implementations, controller 122 receives a setpoint for a liquid level of one or more of the receivers in $CO_2$ refrigeration system 100.

Controller 122 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some implementations, controller 122 is a local controller for $CO_2$ refrigeration system 100. In other implementations, controller 122 is a supervisory controller for a plurality of controlled subsystems (e.g., a refrigeration system, an AC system, a lighting system, a security system, etc.). For example, controller 122 may be a controller for a comprehensive building management system incorporating $CO_2$ refrigeration system 100. Controller 122 may be implemented locally, remotely, or as part of a cloud-hosted suite of building management applications.

Controller 122 includes a processing circuit 202. Processing circuit 202 is shown to include a processor 204 and memory 206. Processor 204 can be implemented as a general purpose processor, an application specific integrated circuit (ASIC), one or more field programmable gate arrays (FPGAs), a group of processing components, a microcontroller, or other suitable electronic processing components. Memory 206 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 206 may be or include volatile memory or non-volatile memory. Memory 206 may include database components, object code components, script components, or any other type of information structure for supporting the various activities and information structures described in the present application. According to an exemplary implementation, memory 206 is communicably connected to processor 204 via processing circuit 202 and includes computer code for executing (e.g., by processing circuit 202 and/or processor 204) one or more processes or control features described herein.

Controller 122 includes a communications interface 208. Communications interface 208 can be or include wired or wireless interfaces (e.g., jacks, antennas, transmitters, receivers, transceivers, wire terminals, etc.) for conducting electronic data communications. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 208 can include an Ethernet card and port for sending and receiving data via an Ethernet-based communications link or network. In another example, communications interface 208 can include a Wi-Fi transceiver or a cellular or mobile phone transceiver for communicating via a wireless communications network.

Figure 3:
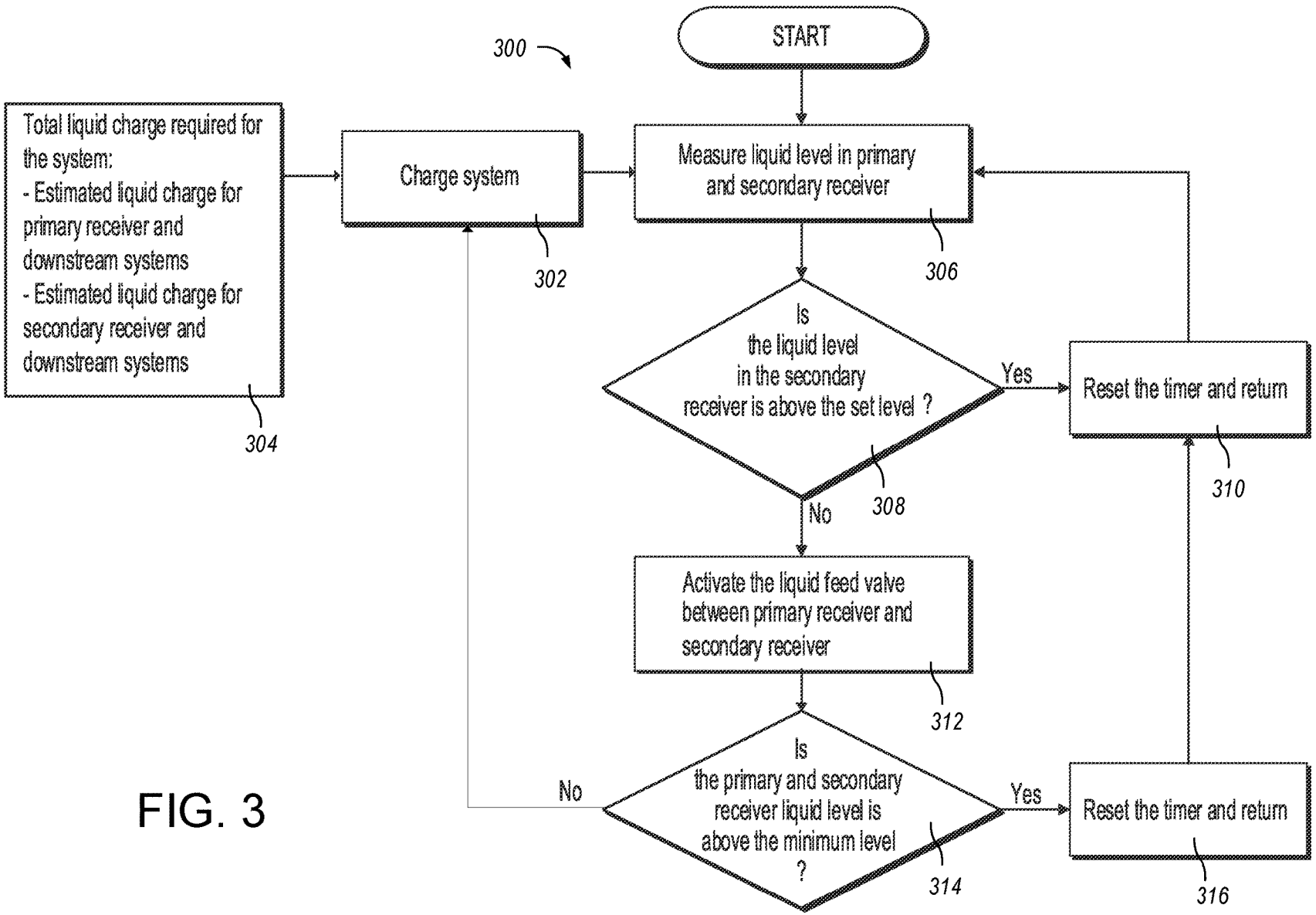
FIG. 3 is a flow diagram of an example process that can be implemented on a multiple receiver refrigeration system according to some implementations.

FIG. 3 is a flow diagram of an example process 300 that can be implemented on a multiple receiver refrigeration system according to some implementations.

The refrigeration system (e.g., $CO_2$ refrigeration system 100) can initially be charged (302) to a total liquid charge required for the system (304). The total charge can include an estimated liquid charge required for primary receiver and systems downstream and an estimated charge required for the secondary receiver and systems downstream. The total charge can include an estimate(s) for summer operation, winter operation, or both.

During operation, the liquid level in primary receiver and secondary receiver are measured (306). A determination is made of whether the liquid level in the secondary receiver is above a set level (308). The set level can be, for example, 50% of receiver volume, or 60% of receiver volume.

If the liquid level in the secondary receiver is above the set level, the timer is reset (310). The system can continue to measure primary and secondary receiver levels.

If the liquid level in the secondary receiver is not above the set level (ex: 50% of receiver volume), the liquid feed valve between the primary receiver and the secondary receiver is opened (e.g., liquid control valve 114) (312).

Based on one or more additional measurements, a determination is made whether the primary receiver and secondary receiver liquid level are both above the minimum level (314). If the total liquid level of primary receiver and liquid receiver is above the minimum level, the timer is reset (316). If the total liquid level of primary receiver and liquid receiver is not above the minimum level, one or more components of the system is recharged (302). For example, refrigerant can be added to a primary receiver, a secondary receiver, or both.

In the example shown in FIG. 1, a $CO_2$ refrigeration system 100 has two receivers. A system may, however, include any number of receivers providing refrigerant to any number of cooling subsystems.

Figure 4:
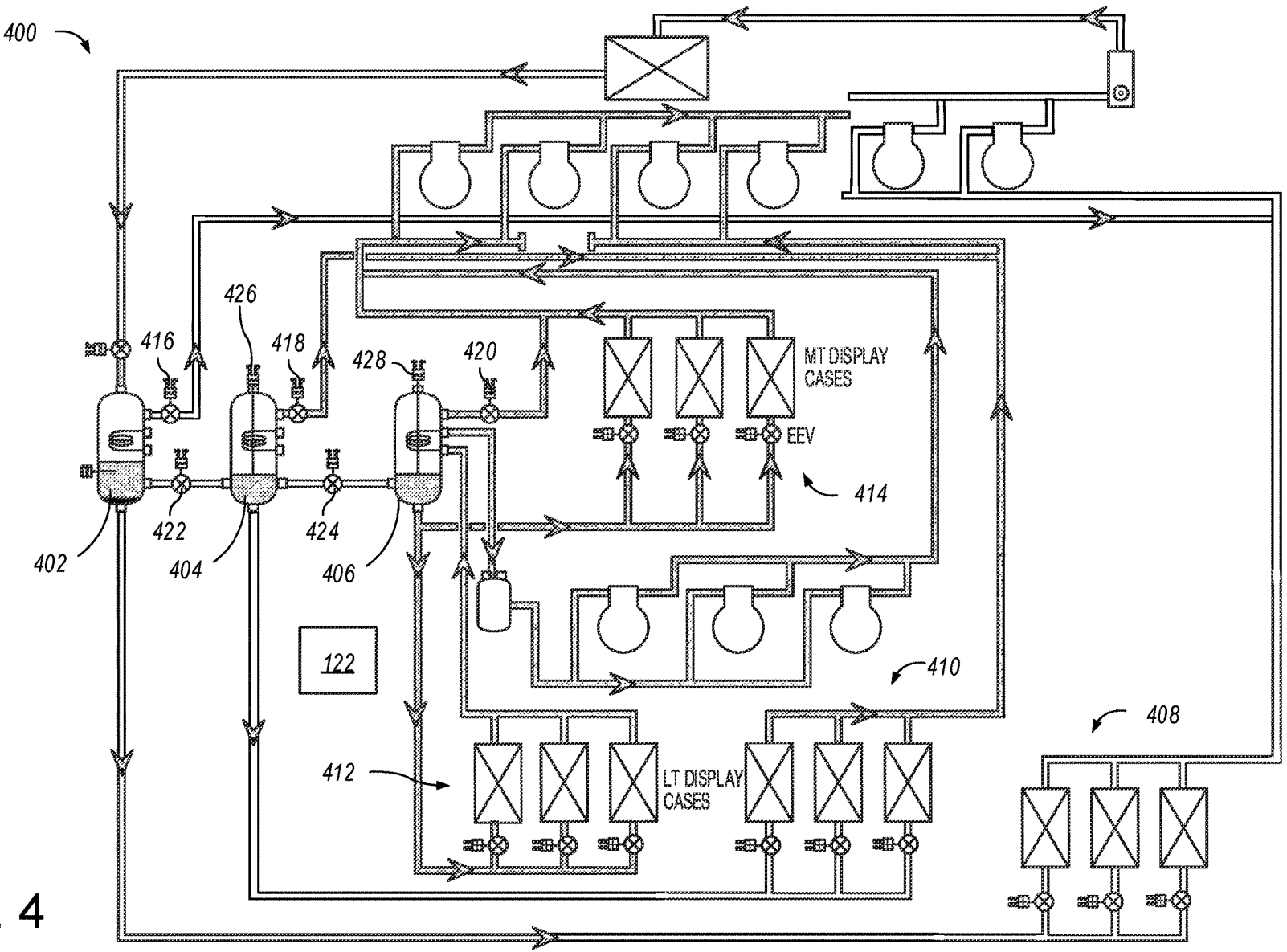
FIG. 4 is a block diagram illustrating an example of a system having three receivers according to some implementations.

FIG. 4 is a block diagram illustrating an example of a system having three receivers. System 400 includes primary receiver 402, secondary receiver 404, and tertiary receiver 406. Primary receiver 402 provides refrigerant to primary subsystem 408. Secondary receiver 404 provides refrigerant to secondary subsystem 410. Tertiary receiver 406 provides refrigerant to LT sub-system 412 and MT subsystem 414.

System 400 includes primary gas bypass valve 416, secondary gas bypass valve 418, tertiary gas bypass valve 420. Each of the gas bypass valves can control a pressure level in one of the respective receivers. Feed control valve 422 between primary receiver 402 and secondary receiver 404 can be operated to control a liquid level in secondary receiver 404. Feed control valve 424 between secondary receiver 404 and secondary receiver 406 can be operated to control a liquid level in tertiary receiver 404. Level sensors 426 and 428 provide sensor data that can be used by controller 122 to control liquid levels in secondary receiver 404 and tertiary receiver 406.

In the example shown in FIG. 4, tertiary receiver 406 provides refrigerant to an LT subsystem and an MT subsystem. Other arrangements of multiple receivers and subsystems can be included in various implementations. For example, a secondary receiver can be dedicated to provide refrigerant solely to an LT subsystem, while a tertiary receiver can be dedicated to provide refrigerant only to an MT subsystem. Other examples include arrangements in which a primary receiver provides refrigerant to one of the following: (a) an MT subsystem; (b) an LT subsystem; (c) an MT and a LT system; (d) an air conditioning system; (e) an MT subsystem and an air conditioning system; (f) an air conditioning system and an LT subsystem; and (g) an air conditioning system, an MT system, and an LT subsystem. In addition, any combination of the above can be applied to secondary and tertiary receivers.

In one implementation, a primary receiver and a secondary receiver provide refrigerant to MT subsystems at different evaporating temperatures. In another implementation, a secondary receiver and a tertiary receiver provide refrigerant to LT subsystems at different temperatures. In still another implementation, a primary receiver provides refrigerant to an air conditioning system, a secondary receiver provides refrigerant to an MT subsystem, and a tertiary receiver provides refrigerant to an LT subsystem.

Figure 5:
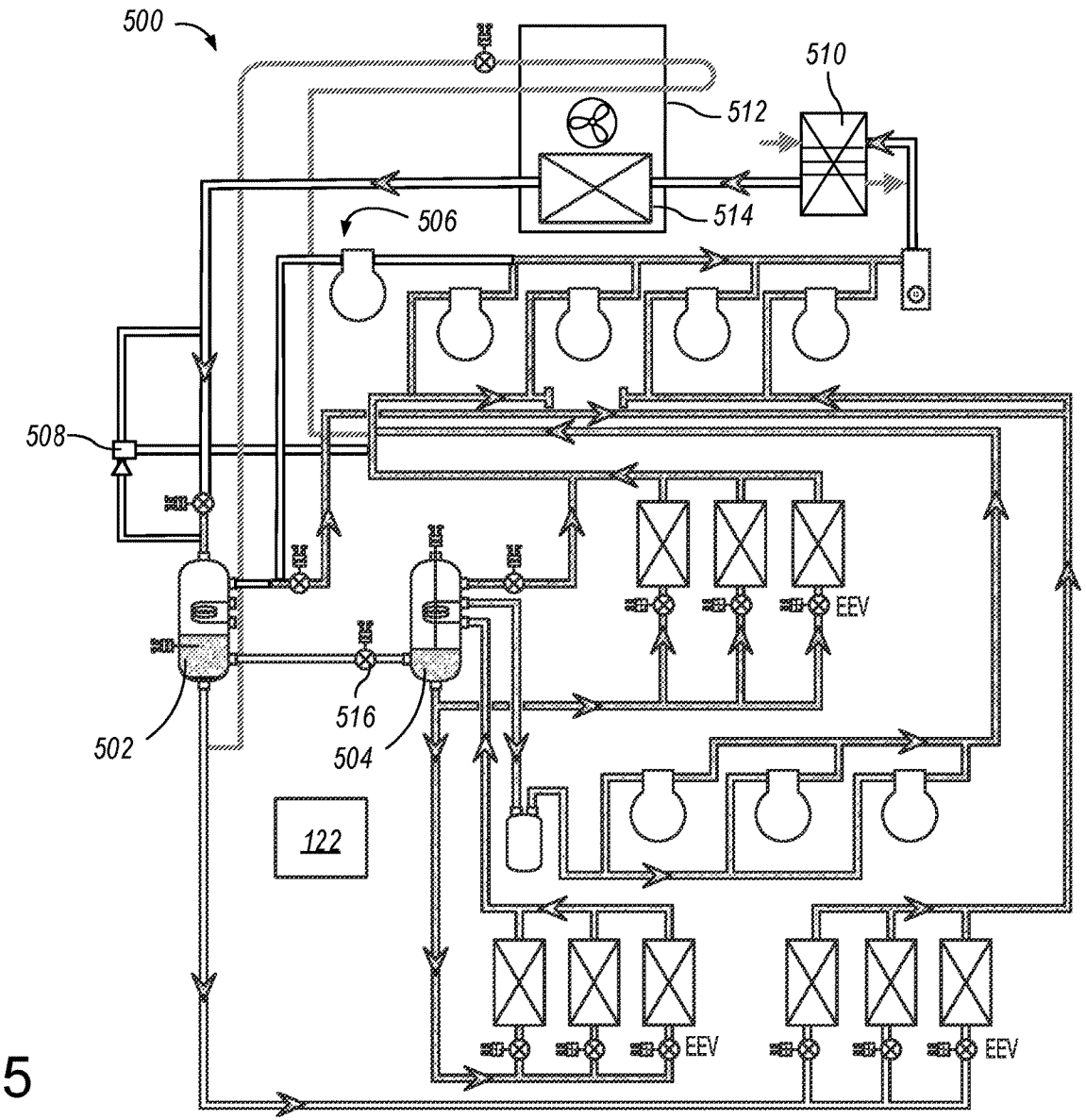
FIG. 5 is a block diagram of an example of a refrigeration system according to some implementations.

In some implementations, a $CO_2$ refrigeration system having multiple receivers includes an ejector, flash gas heat exchanger, heat reclamation, parallel compression, or combinations thereof. Examples of ejectors that can be employed include: liquid ejectors, high-pressure ejectors, low-pressure ejectors, and combination ejectors. FIG. 5 is a block diagram of a $CO_2$ refrigeration system according to some implementations. System 500 includes primary receiver 502, secondary receiver 504, parallel compressor 506, ejector 508, and heat recovery unit 510. In this example, a gas cooler intercooler evaporator 512 is coupled to condenser 514. Parallel compressor 506 is configured to receive a flow from of gas refrigerant from primary receiver 502. Primary receiver 502 and secondary receiver 504 provide liquid refrigerant to various heat load subsystems. Liquid feed valve 516 can be operated to control a liquid level in secondary receiver 504. Pressure control of receivers and control of the heat load subsystems can be similar to that described above with respect to FIGS. 1 through 4.

Figure 6:
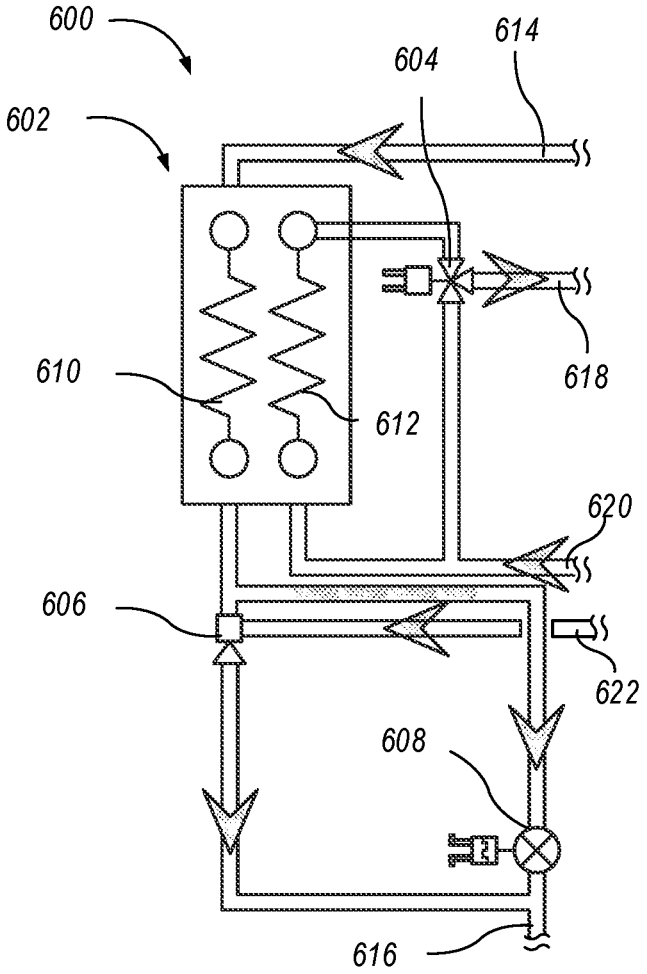
FIG. 6 is a block diagram illustrating a portion of a $CO_2$ transcritical booster system having a heat exchanger and ejector according to some implementations.

FIG. 6 is a block diagram illustrating a portion of a $CO_2$ refrigeration system including an ejector and flash gas heat exchanger according to some implementations. $CO_2$ refrigeration system 600 includes heat exchanger 602, heat exchanger 3-way valve 604, ejector 606, and high pressure valve 608. Heat exchanger 602 includes coil 610 and coil 612. Coil 610 is in heat transfer communication with coil 612, such that heat in fluid passing through coil 610 is transferred to fluid passing through coil 612.

Heat exchanger 602 receives a flow of refrigerant from a gas cooler (such as gas cooler 102 shown in FIG. 1) via conduit 614. Refrigerant passes to one or more receivers via conduit 616. Conduit 618 can be fluidly coupled to the suction side of one or more parallel compressors (such as parallel compressor 506 shown in FIG. 5). Conduit 620 can be coupled to a flash gas outlet of one or more receivers. Conduit 622 can receive refrigerant from the the output of one or more evaporators of a cooling subsystem (such as MT subsystem 116 shown in FIG. 1). In various implementations, ejector 606 can be a high pressure ejector, a low pressure lift ejector, or a combination ejector. In certain implementations, conduit 622 receives refrigerant from a liquid accumulator of an MT subsystem.

In various examples described above, a facility includes low temperature and medium temperature loads and corresponding low temperature and medium temperature cooling systems. In other implementations, a facility can have only low temperature loads and medium temperatures loads and/or cooling systems.

In various examples described above, a $CO_2$ refrigeration system is cooled by an adiabatic gas cooler. In other implementations, a $CO_2$ refrigeration system can be cooled by other systems, such as an air cooled or water cooled device.

The present disclosure contemplates methods, systems and program products on memory or other machine-readable media for accomplishing various operations. Systems and processes described in the present disclosure may be implemented using existing computer processors, or by a special purpose computer processor for an appropriate system, incorporated for this or another purpose, or by a hardwired system. Implementations within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Particular embodiments of the subject matter have been described. Other embodiments, alterations, and permutations of the described embodiments are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example embodiments do not define or constrain this disclosure. Other changes, substitutions, and alterations are also possible without departing from the spirit and scope of this disclosure.

What is claimed is:

1. A refrigeration system, comprising:

a primary receiver having a primary receiver operating pressure and configured to collect a refrigerant circulated by the refrigeration system and comprising:

a primary receiver inlet through which the refrigerant enters the primary receiver;

a primary receiver gas outlet through which a gas refrigerant exits the primary receiver to a first suction line of one or more first compressors in a first set of compressors;

a first primary receiver liquid refrigerant outlet through which at least part of a liquid refrigerant exits the primary receiver; and a second primary receiver liquid refrigerant outlet;

a secondary receiver having a secondary receiver operating pressure that is less than the primary receiver operating pressure, the secondary receiver comprising:

a liquid refrigerant inlet fluidly coupled to the primary receiver and configured to receive the at least part of the liquid refrigerant from the primary receiver; and a secondary receiver gas outlet through which a second gas refrigerant exits the secondary receiver to a second suction line fluidly coupled to one or more second compressors in the first set of compressors and fluidly decoupled from the first suction line, the one or more second compressors of the first set of compressors operating in parallel with the one or more first compressors of the first set of compressors;

a first gas bypass valve fluidly coupled to the primary receiver gas outlet and operable to control a flow of the gas refrigerant from the primary receiver through the first gas bypass valve and to the one or more first compressors in the first set of compressors through the first suction line;

a second gas bypass valve fluidly coupled to the secondary receiver gas outlet and operable to control a flow of the second gas refrigerant from the secondary receiver through the second gas bypass valve and to the one or more second compressors of the first set of compressors through the second suction line;

one or more first evaporators comprising a first group of evaporators and a second group of evaporators, the second group of evaporators comprising a group of low temperature (LT) evaporators, and the primary receiver is configured to direct another part of the liquid refrigerant to the first group of evaporators, and the secondary receiver is configured to direct at least a portion of the at least part of the liquid refrigerant to the second group of evaporators;

one or more second evaporators configured to operate at a different pressure than the one or more first evaporators, the one or more second evaporators fluidly coupled with and configured to direct part of the refrigerant to the one or more second compressors operating in parallel, the one or more second compressors configured to operate in a transcritical state, the secondary receiver comprising a secondary receiver liquid refrigerant outlet through which a part of the liquid refrigerant exits to the one or more second evaporators;

a feed control valve coupled between the primary receiver liquid outlet and the liquid refrigerant inlet of the secondary receiver; and a controller configured to operate the feed control valve to control a flow of the at least part of the liquid refrigerant from the primary receiver to the secondary receiver.

2. The refrigeration system of claim 1, wherein:

the receiver operating pressure in the primary receiver is between 60 bar and about 90 bar; and the receiver operating pressure in the secondary receiver is less than 60 bar.

3. The refrigeration system of claim 1, wherein the controller is configured to operate the feed control valve to maintain a level of the liquid refrigerant in the secondary receiver at a setpoint.

4. The refrigeration system of claim 1, wherein the controller is configured to operate the feed control valve to maintain a level of the liquid refrigerant in the secondary receiver within a predetermined range.

5. The refrigeration system of claim 1, wherein the controller is configured to maintain a level of the liquid refrigerant in the primary receiver at or above a minimum level.

6. The refrigeration system of claim 1, wherein the controller is configured to maintain a level of the liquid refrigerant in the primary receiver at or above a minimum level and a level of the liquid refrigerant in the secondary receiver at or above a minimum level.

7. The refrigeration system of claim 1, wherein the feed control valve comprises a pressure regulator valve.

8. The refrigeration system of claim 1, wherein the feed control valve comprises a solenoid valve.

9. The refrigeration system of claim 1, wherein the one or more first compressors comprise a first group of transcritical compressors fluidly coupled to the primary receiver gas outlet, and the one or more second compressors comprise a second group of transcritical compressors fluidly coupled to the secondary receiver gas outlet.

10. The refrigeration system of claim 1, wherein the refrigeration system comprises a first subsystem and a second subsystem, wherein the first subsystem receives the liquid refrigerant from the primary receiver, wherein the second subsystem receives the liquid refrigerant from the secondary receiver.

11. The refrigeration system of claim 1, wherein:

the refrigeration system further comprises a medium temperature (MT) subsystem configured to receive the liquid refrigerant from the secondary receiver, the first set of compressors is a set of MT compressors configured to operate in a transcritical state, and the MT subsystem comprises the set of MT compressors, the one or more second evaporators, and one or more MT expansion valves.

12. The refrigeration system of claim 1, wherein:

the refrigeration system further comprises a low temperature (LT) subsystem configured to receive the liquid refrigerant from the secondary receiver; and the LT subsystem comprises one or more LT compressors configured to operate in a subcritical state, the group of LT evaporators, and one or more LT expansion valves.

13. The refrigeration system of claim 1, wherein the refrigeration system further comprises:

an LT subsystem and an MT subsystem each configured to receive the liquid refrigerant from the secondary receiver; and a primary subsystem configured to receive the liquid refrigerant from the primary receiver.

14. The refrigeration system of claim 1, further comprising an ejector fluidly coupled between a gas cooler of the refrigeration system and the primary receiver.

15. The refrigeration system of claim 1, further comprising one or more subcritical compressors operating in series with the first set of compressors that operate in parallel.

16. The refrigeration system of claim 1, further comprising an additional receiver configured to receive the liquid refrigerant from the secondary receiver.

17. The refrigeration system of claim 1, wherein the refrigerant is carbon dioxide.

18. The refrigeration system of claim 1, wherein the first set of compressors comprises medium temperature (MT) compressors configured to operate in a transcritical state, the refrigeration system further comprises one or more low temperature (LT) compressors configured to operate in a subcritical state, the primary receiver gas outlet of the primary receiver is fluidly coupled with the MT compressors, and the second primary receiver liquid refrigerant outlet of the primary receiver is fluidly coupled with the first group of evaporators.

19. The refrigeration system of claim 13, wherein the primary subsystem comprises an air-conditioning system.

20. The refrigeration system of claim 13, wherein the primary subsystem comprises a process cooling loop.

21. The refrigeration system of claim 18, wherein the LT compressors are fluidly coupled with and configured to direct gas refrigerant to the one or more second compressors operating in parallel.

22. The refrigeration system of claim 18, wherein the secondary receiver is fluidly coupled with and configured to direct refrigerant to the MT compressors, MT evaporators, and the LT evaporators.

23. A refrigeration system, comprising:

two or more receivers configured to collect refrigerant circulated by the refrigeration system, a first one of the receivers comprising a first gas outlet through which a gas refrigerant exits the first one of the receivers to a first suction line of one or more first compressors in a first set of compressors, and a second one of the receivers comprising a second gas outlet through which the gas refrigerant exits the second one of the receivers to a second suction line of one or more second compressors in the first set of compressors, the one or more second compressors of the first set of compressors operating in parallel with the one or more first compressors of the first set of compressors;

a liquid refrigerant feed line between a first liquid refrigerant outlet of the first one of the receivers and a liquid refrigerant inlet of the second one of the receivers having a receiver operating pressure lower than a receiver operating pressure of the first one of the receivers;

one or more first evaporators comprising a first group of evaporators and a second group of evaporators, the second group of evaporators comprising a group of low temperature (LT) evaporators, and the first one of the receivers is configured to direct a first liquid refrigerant to the first group of evaporators, and the second one of the receivers is configured to direct a second liquid refrigerant to the second group of evaporators;

a fluid conduit fluidly connecting a second liquid refrigerant outlet of the first one of the receivers with the first group of evaporators of the one or more first evaporators;

one or more second evaporators configured to operate at a different pressure than the one or more first evaporators, the one or more second evaporators fluidly coupled with and configured to direct part of the gas refrigerant to the one or more second compressors operating in parallel, the one or more second compressors configured to operate in a transcritical state, the second one of the receivers comprising a secondary receiver liquid refrigerant outlet through which a part of the second liquid refrigerant exits to the one or more second evaporators;

one or more feed control valves in the liquid refrigerant feed line; and a controller configured to operate the feed control valves to control a level of the liquid refrigerant in at least the second one of the receivers.

24. The refrigeration system of claim 23, wherein:

the two or more receivers comprise a primary receiver, a secondary receiver, and a tertiary receiver, the secondary receiver receives a flow of the liquid refrigerant from the primary receiver and has a secondary receiver operating pressure that is lower than the primary receiver operating pressure, the tertiary receiver receives a flow of the liquid refrigerant from the secondary receiver and has a tertiary receiver operating pressure that is lower than the secondary receiver operating pressure.

25. The refrigeration system of claim 23, wherein the refrigerant is carbon dioxide.

26. A method for operating a refrigeration system, the method comprising:

collecting a refrigerant circulated by the refrigeration system within a primary receiver having a primary receiver operating pressure, the primary receiver comprising a primary receiver gas outlet through which a gas refrigerant exits the primary receiver to a first suction line of one or more first compressors in a first set of compressors, the primary receiver comprising a first liquid refrigerant outlet through which at least part of a liquid refrigerant exits the primary receiver, and a second liquid refrigerant outlet through which another part of the liquid refrigerant exits the primary receiver to one or more first evaporators;

providing the at least part of the liquid refrigerant from the primary receiver to a secondary receiver having a secondary receiver operating pressure that is lower than the primary operating pressure;

operating a first gas bypass valve fluidly coupled to the primary receiver gas outlet to control a flow of the gas refrigerant from the primary receiver through the first gas bypass valve and to the first suction line;

operating a second gas bypass valve fluidly coupled to a secondary receiver gas outlet to control a flow of the gas refrigerant from the secondary receiver through the second gas bypass valve and to a second suction line of one or more second compressors in the first set of compressors;

operating a feed control valve to control a flow of the at least part of the liquid refrigerant from the primary receiver to the secondary receiver; and operating the one or more first compressors in parallel with the one or more second compressors;

wherein the refrigeration system further comprises one or more expansion valves and one or more second evaporators configured to operate at a different pressure than the one or more first evaporators, the one or more second evaporators fluidly coupled with the one or more expansion valves and the one or more second compressors operating in parallel, the secondary receiver comprising a secondary receiver liquid refrigerant outlet through which at least a second part of the liquid refrigerant exits to the one or more expansion valves, and the method further comprises operating the one or more expansion valves to expand the second part of the liquid refrigerant received from the secondary receiver liquid refrigerant outlet, and direct the expanded refrigerant to the one or more second evaporators, and the method further comprises providing the another part of the liquid refrigerant from the primary receiver to a first group of evaporators of the one or more first evaporators, and providing a third part of the liquid refrigerant from the secondary receiver to a second group of evaporators of the one or more first evaporators, the second group of evaporators comprising a group of low temperature (LT) evaporators.

27. The method of claim 26, wherein operating the feed control valve to control a flow of the at least part of the liquid refrigerant from the primary receiver to the secondary receiver comprises maintaining a liquid level in the secondary receiver within a particular operating range.

28. The method of claim 26, further comprising:

monitoring a liquid refrigerant level in the primary receiver, and maintaining the liquid refrigerant level in the primary receiver at or above a predetermined minimum level.

29. A method for operating a refrigeration system, the method comprising:

collecting a gas refrigerant circulated by the refrigeration system within a primary receiver having a primary operating pressure, the primary receiver comprising a primary receiver gas outlet through which a gas refrigerant exits the primary receiver to a first suction line of one or more first compressors in a first set of compressors, the primary receiver comprising a first liquid refrigerant outlet through which at least part of a liquid refrigerant exits the primary receiver, and a second liquid refrigerant outlet through which another part of the liquid refrigerant exits the primary receiver to one or more first evaporators;

providing the at least part of the liquid refrigerant from the primary receiver to a secondary receiver having a secondary receiver operating pressure that is less than the primary receiver operating pressure, the secondary receiver comprising a secondary receiver gas outlet to which the gas refrigerant exits the secondary receiver to a second suction line of one or more second compressors in the first set of compressors;

operating a feed control valve to control a flow of the at least part of the liquid refrigerant from the primary receiver to the secondary receiver to maintain a level of the liquid refrigerant in the secondary receiver within a particular operating range; and operating the one or more first compressors in parallel with the one or more second compressors;

wherein the refrigeration system further comprises one or more expansion valves and one or more second evaporators configured to operate at a different pressure than the one or more first evaporators, the one or more second evaporators fluidly coupled with the one or more expansion valves and the one or more second compressors operating in parallel, the secondary receiver comprising a secondary receiver liquid refrigerant outlet through which a second part of the liquid refrigerant exits to the one or more expansion valves, the method further comprising operating the one or more expansion valves to expand the second part of the liquid refrigerant received from the secondary receiver liquid refrigerant outlet, and direct the expanded refrigerant to the one or more second evaporators, and the method further comprises providing the another part of the liquid refrigerant from the primary receiver to a first group of evaporators of the one or more first evaporators, and providing a third part of the liquid refrigerant from the secondary receiver to a second group of evaporators of the one or more first evaporators, the second group of evaporators comprising a group of low temperature (LT) evaporators.

30. The method of claim 29, further comprising:

monitoring a liquid refrigerant level in the primary receiver, and maintaining the liquid refrigerant level in the primary receiver at or above a predetermined minimum level.

31. The method of claim 29, further comprising:

receiving a portion of the liquid refrigerant from the secondary receiver into a tertiary receiver; and operating a feed control valve to control a flow of the portion of the liquid refrigerant from the secondary receiver to the tertiary receiver to maintain a level of the portion of the liquid refrigerant in the tertiary receiver within a particular operating range.

* * * * *